United States Patent [19]

Smith, II

[11] 3,936,555

[45] *Feb. 3, 1976

[54] FILLED TEXTILE FABRIC WITH A DENSITY GRADIENT

[75] Inventor: Alexander M. Smith, II, Elkin, N.C.

[73] Assignee: The Fiberwoven Corporation, Elkin, N.C.

[ * ] Notice: The portion of the term of this patent subsequent to June 18, 1991, has been disclaimed.

[22] Filed: Oct. 17, 1973

[21] Appl. No.: 407,169

Related U.S. Application Data

[63] Continuation-in-part of Ser. No. 221,614, Jan. 28, 1972, Pat. No. 3,817,820.

[52] U.S. Cl. ..... 428/151; 28/72.2 R; 428/218; 428/286; 428/287; 428/300; 428/301; 428/904

[51] Int. Cl.[2] ..... B32B 5/06; B32B 5/22

[58] Field of Search ..... 161/154, 155, 166, DIG. 2; 28/72.2 R; 428/151, 286, 287, 300, 301, 218, 904

[56] References Cited

UNITED STATES PATENTS 3,206,351 9/1965 Smith ..... 161/154

3,817,820 6/1974 Smith ..... 161/154

*Primary Examiner*—Marion E. McCamish

*Attorney, Agent, or Firm*—Cushman, Darby & Cushman

[57] ABSTRACT

A textile fabric with a dense intensely entangled reticular fibrous structure and process for manufacture thereof are provided wherein staple fibers are needled into a high bulk density structure with a bulk density gradient wherein the bulk density increases from the back surface to the face surface of the structure. The needled structure is impregnated with a liquid phase filler and capillary action preferentially disposes the liquid phase filler toward the more dense face surface. The filler is coagulated and dried, cured, etc., into particles which are at most loosely bonded to the fibers. The preferential disposition of the filler increases the bulk density gradient of the filled fabric.

40 Claims, 7 Drawing Figures

FILLED TEXTILE FABRIC WITH A DENSITY GRADIENT

RELATED APPLICATIONS

This is a continuation-in-part of co-pending application Ser. No. 221,614, filed on Jan. 28, 1972, now U.S. Pat. No. 3,817,820, entitled NEEDLED TEXTILE FABRIC, the entire disclosure which is incorporated herein by reference.

BACKGROUND OF THE INVENTION

The aforementioned specification discloses methods and apparatus for producing novel textile fabrics. In a preferred embodiment, textile fibers are needled together into an integral structure with a face surface and back surface and having coherent fiber entanglement. The needled structure has a high overall bulk density and a bulk density gradient in which the bulk density increases from the back surface to the face surface, i.e., the bulk density is greater at the face surface than at the back surface. A plurality of layers of fibers are superimposed on one another, e.g., by carding of staple fibers, to form a web of loosely matted fibers having a needle pick-up gradient which increases in the Z direction, i.e., from the back surface to the face surface. The web is needled until a resulting structure has an overall bulk density of at least six pounds per cubic foot, e.g., at least eight to twelve pounds per cubic foot, and the ratio of the bulk density at the back surface to the bulk density at the face surface is in the range of at least 1:2 to as high as 1:8, preferably 1:3 to 1:5. Also, the fabric has a controlled axis of flexure which lies at least within 0.4, e.g., 0.3, and especially 0.2 or 0.1, of the distance from the face surface to the back surface. Some of the fiber entanglement includes fibers being oriented into closely spaced rows of fiber chain entanglement, the rows extending lengthwise of the structure. The bulk density gradient of the needled structure may be accomplished by positioning a plurality of superimposed layers of staple fibers so that the average fiber denier and/or length of the fibers of the layers decreases from the back surface to the face surface, the average fiber deniers being ½ or less up to 8 or more, especially to 5, and the average fiber length being ¾ inch or less up to 4 inches or more, especially 1 inch to 3 inches. Further, bulk density of the needled structure may be accomplished by laying on the face surface of the needled structure a web of at least one layer of relatively short loosely matted fibers (less than 2 inches, e.g., 1/16 to ¾ inch) and needling the short fibers to increase the bulk density of the structure to at least 10 pounds per cubic foot, e.g., 12 pounds per cubic foot, and produce a dense region of bulk density higher than the bulk density of the remaining portion of the needled structure. The axis of flexure of the needled structure will lie close to, e.g., within or adjacent to the dense region.

Preferably, the structure is then relaxed, e.g., mechanically relaxed, to loosen the structure and adjust the modulus thereof. It is also preferred that the structure be further densified by shrinking the fibers at and adjacent to the face surface to define a compacted region of higher bulk density near the face surface. The fibers at and adjacent to the face surface are, accordingly, at least in part shrinkable fibers (heat and/or solvent shrinkable), and densification may be accomplished by applying heat or solvents to the face surface (while maintaining the back surface relatively cool when heat shrinking. This product may be used for many purposes, but the fabric is preferably impregnated with a filler to further raise the overall bulk density of the fabric and provide higher densities. Also, the filled fabric may be used for many purposes without further processing. Alternately, the filled fabric may be finished by mechanical processes such as buffing, working, sanding and embossing or chemical processes such as adding softeners, sizes, or applying a conventional finish material, e.g., a leather finish, to the face surface. The filler is disposed within the open interstices between the fibers of the needled fabric, and the filler is preferably an elastomer, e.g., natural rubber, in the form of solid particles, especially clusters of particles which are predominantly loosely bonded to the fibers. The filler is disposed in the fabric in an amount insufficient to fill all the interstices between the fibers, e.g., between 10% and 200% of the weight of the fibers in the needled structure. The filled fabric preferably has overall bulk densities of between 20 and 60 pounds per cubic foot, although densities outside of this range may be accomplished, if desired.

It is further preferred that the needled structure have an overall bulk density of at least 12 pounds per cubic foot, a ratio of density at the back surface to the density at the face surface of at least 1:2, and be impregnated with the filler to provide overall densities of between about at least 25 pounds per cubic foot, e.g., 30–45 pounds per cubic foot, or more, e.g., up to 50 pounds per cubic foot.

The addition of the filler to the needled structure is made in such a manner so as to at least preserve the bulk density gradient of the needled structure, i.e., with the bulk density increasing from the back surface of the needled structure to the face surface thereof. Preferably, however, the filler is added to the needled structure so that not only is the bulk density gradient preserved but that the bulk density gradient of the filled fabric is increased, i.e., the filler is preferentially disposed toward the face surface of the fabric. This preferential disposition of filler is illustrated in the photomicrograph of the filled fabric in the parent application.

Preferential disposition of the filler in the needled structure, according to an embodiment of the parent application, is accomplished by contacting the needled structure with a liquid filler composition (latex emulsion in the preferred embodiment) and then passing the structure between counter-rotating rolls to lightly squeeze the structure and produce add-ons of liquid filler composition which are less than saturation amounts. When the needled structure contains less than saturation amounts of the liquid filler composition, i.e., the voids in the structure are not filled by the liquid filler composition, capillary action will move the liquid filler composition toward the face surface of the needled structure where the fibers are more densely entangled, i.e., the average space between fibers is less than in any other portion of the needled fabric. Stated in another way, the liquid filler composition will inherently migrate by capillary action toward the portion of the needled structure where the fibers are in a closer spaced relationship, i.e., toward the more dense portions of the structure. Thus, when the liquid filler composition is coagulated and cured, dried, etc., in that preferential disposition, the filled fabric has an increased bulk density gradient from the back surface to the face surface beyond that provided by the needled structure alone.

As disclosed in the aforementioned parent application, the filler in the needled structure provides a hand and feel and increased density and support for surface finishes, which are advantageous in producing the artificial leathers of the parent application. The filler also provides additional suppleness and shape retention properties to the needled structure so as to prevent collapse of the interstices between individual fibers when the fabric is used. Further, as disclosed in a copending application Ser. No. 403,059, entitled FABRIC WITH THIN SURFACE MATRIX AND METHOD FOR PRODUCTION THEREOF, filed on Oct. 3, 1973, (the entire disclosure of which is incorporated herein by reference and relied upon), the filler aids in embossing the fabric to produce a surface matrix resembling leather.

OBJECTS OF THE INVENTION

It is an object of the present invention to provide products and methods for production thereof wherein the advantageous properties of the products disclosed in the parent application are enhanced. It is a further object of the invention to provide methods and products wherein the enhanced properties of the aforenoted parent application can be more predictably and more controllably provided. It is yet a further object of the invention to provide alternate methods for producing the products with the enhanced properties. Other objects will be apparent from the following disclosure and claims.

BRIEF DESCRIPTION OF THE INVENTION

The invention provides a textile fabric which is characterized by its high bulk density, network of entangled fibers and positioned and controlled axis of flexure. The fabric is comprised of textile fibers needled together into an integral structure having coherent fiber entanglement and a filler within the needled structure, preferentially disposed toward the face surface thereof. The fabric has an overall bulk density gradient wherein the bulk density increases from the back surface of the fabric to the face surface of the fabric. The fabric has an axis of flexure which lies within about 0.4 of the distance from the face surface to the back surface.

Also, according to the invention, there is provided a method for producing the said textile fabric comprising needling textile fibers together into an integral structure with a face surface and a back surface, and wherein the bulk density of the needled fibers increases from the back surface to the face surface, and produces an axis of flexure within 0.4 of the distance from the face surface to the back surface, applying a liquid phase filler to the needled structure in an amount insufficient to fill the voids in the needled structure, lagging the structure for a time sufficient to allow the liquid phase filler to move by capillary action toward the face surface of the structure and coagulating the filler from the liquid phase into particulate form which is at most loosely bonded to the fibers of the needled structure and removing the liquid phase from the structure, whereby the fabric has an overall bulk density of between 20 and 60 pounds per cubic foot and the bulk density gradient wherein the bulk density gradient and positioned axis of flexure of the needled fabric is at least preserved.

DETAILED DESCRIPTION OF THE INVENTION

As disclosed in the parent application and as briefly summarized above, a needled fabric is prepared by forming a web of loosely matted fibers wherein the fibers of the web have a needle pick-up gradient from the back surface to the face surface of the web. After appropriate web handling, such as conveying, compacting and the like, the web is needled sufficiently to produce an integral structure of cohering entangled fibers. The needled structure has an overall bulk density of at least 6 pounds per cubic foot and the ratio of the bulk density at or near the back surface of a needled structure to the bulk density at or near the face surface thereof is at least 1:2. The needled structure also has an axis of flexure which lies within at least 0.4 of the distance in the face surface to the back surface.

Generally, the local density within the structure increases from the back surface to the face surface. However, the density need not continually increase from the back surface to the face surface and, indeed, it is often desired that a succeeding portion of the needled structure, along the cross-section thereof, have a density lower than a preceding portion and lower than a subsequent succeeding portion. However, the needled structure will have an overall bulk density gradient wherein the bulk density generally increases from the back surface to the face surface of the needled fabric.

Figure 1:
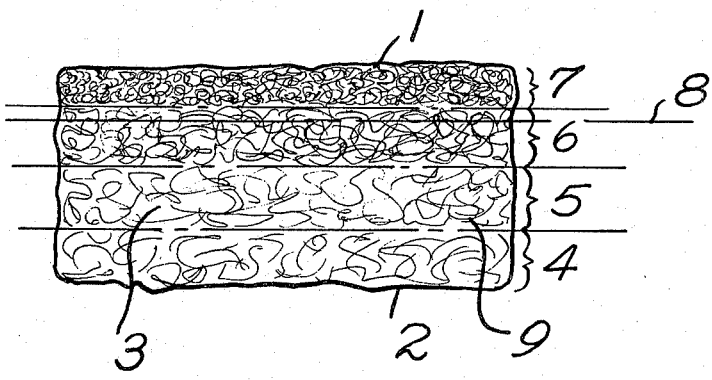
FIG. 1 is a diagrammatic illustration of the needled structure produced according to the aforenoted parent application.

The type of product discussed above can be illustrated by the diagrammatic drawing of FIG. 1. The fabric will have a face surface region of high bulk density 1, a back surface region of relatively low bulk density 2, and be made of entangled needled fibers 3. The bulk density will increase from the back surface 2, generally, as explained above, to the face surface 1 and this increase is illustrated as regions 4 through 7. Thus, the bulk density of region 5 will, generally, be greater than the bulk density of region 4, and likewise the bulk density of region 6 will be greater than 5, and the bulk density of region 7 will be greater than that of region 6. As an illustration of the foregoing, the bulk density of the needled structure just at or near the back surface could have a value of about 6 to 10 pounds per cubic foot. The bulk density in region 4 could be in the range of 10 to 14 pounds per cubic foot and the bulk density in region 5 could be about 14 to 16 pounds per cubic foot. Similarly, the bulk density in region 6 could be about 16 to 22 pounds per cubic foot and the bulk density in region 7 could be about 22 to 26 pounds per cubic foot. Finally, the bulk density at or near the face surface could be about 26 to 30 pounds per cubic foot.

Bulk density gradients of the foregoing nature will cause a shift of the axis of flexure from the center line of the cross-section of the structure to near the face surface. In FIG. 1, the axis of flexure is indicated at 8, although it should be understood that the axis of flexure may lie as far as 0.4 of the distance from the face surface to the back surface.

Figure 2:
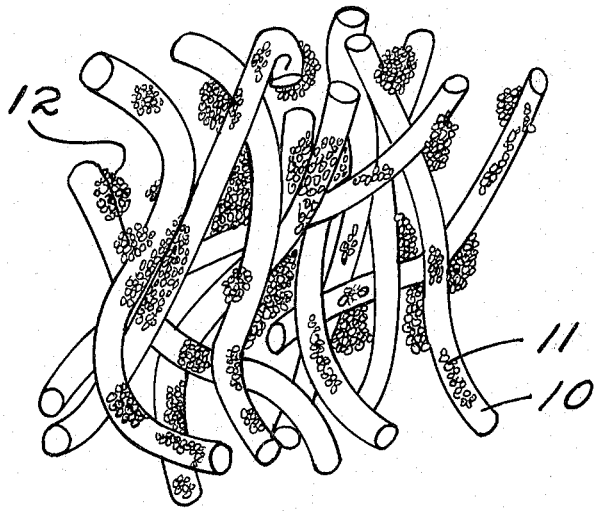
FIG. 2 is a diagrammatic illustration of the disposition of filler within the needled structure of FIG. 1.

As noted in the parent application, filler is disposed within the needled fabric in such a manner that the particles of filler are only loosely bonded to the fibers of the needled structure. In the case of the preferred embodiment in the parent application, where compounded natural rubber deposited from a latex emulsion is used as the filler, the individual particles of rubber may be disposed in the form of clusters of individual particles. The latex rubber particles contact and touch the fibers of the needled structure, as particles or clusters, but the particles do not tightly adhere or bond to the fibers of the needled structure. The latex rubber filler is disposed within the needled structure in an amount such that the interstices between the fibers are not completely filled. Thus, the structure retains open pores, while at the same time, the overall bulk density of the structure is increased by the filler and the rubber latex particles provide resiliency and stability to the structure. This disposition of filler is illustrated in the highly idealized drawing of FIG. 2, where fibers 10 have particles of filler 11, often in clusters 12, disposed thereon.

Figure 3:
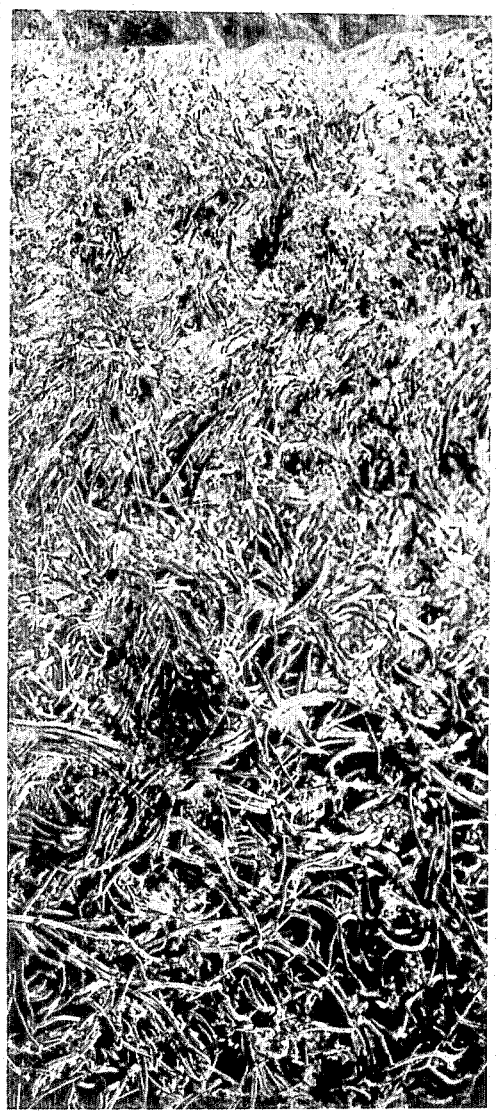
FIG. 3 is a 30X photomicrograph of a 20° slant cross-section of the product of the present invention.
Figure 4:
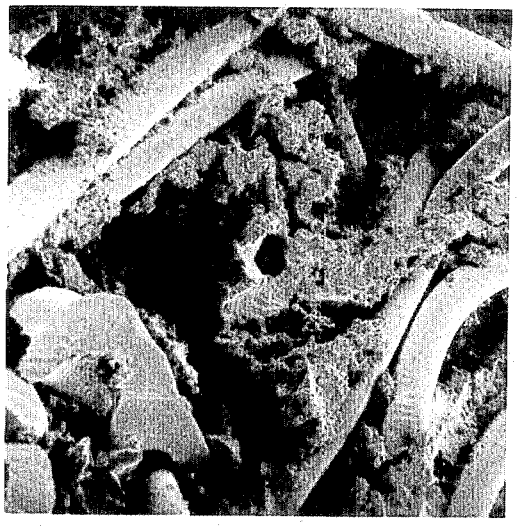
FIG. 4 is a 600X photomicrograph of a portion of a section of the product of the invention.
Figure 5:
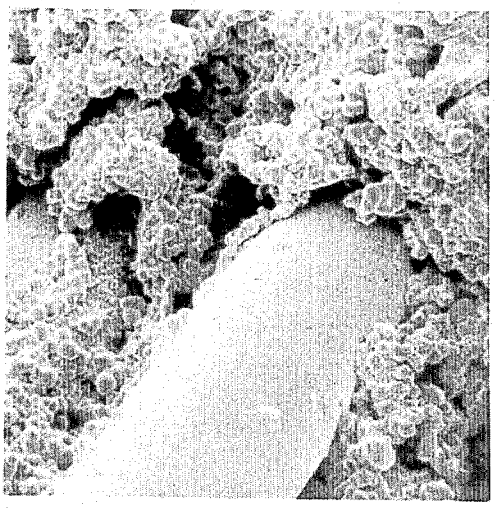
FIG. 5 is a 2300X photomicrograph of a portion of a section of the product of the invention.

As can be seen from FIGS. 3 through 5, the filler is, generally, in particulate form. While individual particles or portions of the filler may be contiguous with other particles or portions of the filler, the filler is in non-continuous form i.e., the filler is not a unitary mass which co-acts with other portions of the filler. Since the filler is only loosely bonded to the fibers, at most, and is in a non-continuous form, it is preferred that the individual particles or aggregates of particles be of irregular shape and/or of sufficient size so as to be substantially retained within the needled structure even during mechanical working, i.e., during flexing.

As can be appreciated from FIGS. 1 through 5, a teaching of the parent application is that of producing a reticular fibrous structure, i.e., a dense network of intensely entangled fibers and the intensity of entanglement increased from the back surface to the face surface. As the fibers are entangled with greater intensity, the average distance or space between fibers becomes less. Capillary action to move a liquid phase filler through the entangled fibers increases with decreased distances between adjacent fibers, i.e., with increased fiber entanglement. Thus, the capillary action exerted on the liquid phase filler increases with the bulk density. Therefore, as can be visualized from FIG. 1, if liquid phase filler is disposed relatively uniformly throughout the needled structure of FIG. 1 but in amounts such that the interstices between fibers are not completely filled with the liquid phase filler, i.e., voids remain in the structure, then the inherent capillary action produced by the network of entangled fibers will preferentially dispose the liquid phase filler toward the face surface of the needled structure, i.e., the more dense portion of the needled structure. Thus, it can also be understood that an inherent function of the bulk density gradient is to produce capillary action which will cause movement of the liquid phase filler toward the face surface of the structure. After the liquid phase filler is so disposed within the needled structure by means of capillary action, the filler is coagulated from the liquid phase in a manner to produce minimum further movement of the liquid containing the filler. By this process, the filler is coagulated and deposited in the needled structure preferentially toward the face surface thereof. Of course, at least more than 50% by weight of the filler will be disposed between the geometric center line of the needled structure and the face surface, but, in practice, this preferential disposition of filler will usually be of at least 60%, e.g., 70% or more. Depending upon the particular filler being used, the coagulated or precipitated filler may be further dried, cured, polymerized, etc.

As is well known, capillary action (also known as capillary attraction) is the force of adhesion between a solid and a liquid in capillarity. Capillarity results from the surface tension of the liquid in combination with the geometry of adjacent solid surfaces wetted by the liquid. The capillary force which moves the liquid along the adjacent solids wetted by the liquid is inversely proportional to the relative distance between the adjacent solids being wetted by the liquid. Thus, as noted above, the capillary action increases where the average distance between the fibers is small, i.e., where the fibers lie in close proximity to each other.

The force of gravity may also affect the movement of liquid within the needled structure. If the capillary force is in the same direction as the force of gravity, the result will be an increased tendency for the liquid to move in those directions. On the other hand, if the capillary force is opposite to the force of gravity, the force of gravity will oppose the movement of the liquid by capillary action and decrease the tendency of the liquid to move in that direction. From the foregoing, it can be understood that the orientation of the needled structure in relationship to the surface thereof upon which the application of the liquid phase filler is made will affect the ultimate disposition of the liquid phase filler. For example, if the back surface of the needled structure is in the top-most position and the face surface is in the bottom-most position and the liquid phase filler is applied to the face surface of the fabric, capillary action will move the liquid phase filler from the face surface into the needled structure. However, the force of gravity, being in a direction from the back surface to the face surface, will oppose the movement of the liquid phase filler by capillary action and tend to cause the liquid to be further preferentially disposed near the face surface of the structure. In this case, little liquid will be moved to the back surface of the needled structure. Of course, if the orientation of the face and back surfaces are reversed, i.e., the face surface is in the top-most position, and the liquid phase filler is applied to the bottom-most-disposed back surface, then far more liquid phase filler will tend to be disposed toward the back surface. Like effects will be obtained when the needled structure is saturated and lightly squeezed, i.e., the liquid phase filler is applied relatively uniformly to the needled structure, since the orientation of the structure while capillary action is taking place will cause the force of gravity to either oppose or assist the capillary action and thus decrease or increase the degree of the preferential disposition of the liquid phase filler toward the face surface.

The filler may be any inert solid, either organic or inorganic which contributes to the overall bulk density of the structure and which may be disposed within the structure by a liquid phase capable of exhibiting capillary action, e.g., the filler may be finely divided inorganic materials such as pigments, bentonite, chalk, kaolin, talc, clays, asbestos, diatomaceous earth, silica flour, mica, magnesium silicate, zeolites, carbon black, zinc oxide, barytes, ferric oxide and the like. As noted above, the filler should not adhere to the fibers of the needled structure and in this regard, non-adhesive inorganic fillers are quite suitable. However, in some cases, it is preferred that the fillers be bonded together in clusters and be loosely bonded to the fibers. In this connection, inorganic fillers may be applied to the needled structure in combination with elastomeric fillers, especially an elastomeric adhesive or binder, such as plasticized polyvinyl chloride, natural rubber, butadiene rubbers, polychloroprene rubbers, polyurethane rubbers, silicone rubbers, etc. Also, the filler may be an organic material such as a natural polymer, e.g., collagen or a cellulosic, e.g., wood pulp or wood fibers. Alternately, synthetic polymers or copolymers may be used, such as acrylonitrile polymers, silicone rubbers, chlorosulphonated polyethylene, polyethylene and polypropylene, plasticized polyvinyl chloride, Kel-F type copolymers of tetrafluoroethylene and chlorotrifluoroethylene, fluorosilicone rubbers, such as Silastic LS 35, poly (alkylene oxide) polymers and natural rubbers or any of the conventional leather fillers. Of course, the polymeric filler may be cross-linked or cured.

It is preferred that the filler be elastomeric in nature. By elastomeric in nature, it is meant that the elastomeric filler will have Shore A hardness of about 40–90, a modulus of about 200–4000 psi, at a 100–300% elongation, and a brittle temperature of at least −10°C. (brittle temperature approximates the glass transition temperature). Any of the natural and synthetic elastomers may be used, including polymers and copolymers of butadiene, isobutylene, butene and pentene, polysulfides, polychloroprene, polyesters, e.g., the Paraplex and Norepol rubbers, polyurethane and copolymers of alkylacrylates and vinyl esters. Natural rubber is a preferred filler since it meets all the required elastomeric properties, is inexpensive and is easy to use. Natural rubber is vulcanized for use as a present filler and any of the conventional vulcanizing agents may be used, such as sulfur compounds, peroxides, diazoaminobenzenes, tetraalkylthiuram, disulfides, bisthio acids and salts, quinones, imines, oximes, analines, thazides and phenols in the presence of oxidizing agents, and azodicarboxamides. Conventional accelerators such as thiazoles, dithiocarbamates, aldehydeamines and quanidines may be used in vulcanizing the natural rubber, along with conventional antioxidants and other conventional compounding ingredients (See Fisher, Harry L., Chemistry of Natural and Synthetic Rubbers, Rhinehold Pub. Corp., N.Y. 1957).

The fillers may be applied to the needled structure in any manner desired so long as they are in a "liquid phase" such that the above-described capillary action may take place. Thus, if non-dissolved solids are to be used, they must be in an emulsion or suspension such that the emulsion or suspension acts as a liquid insofar as the capillary action is concerned. Of course, solutions may be used. Accordingly, the term liquid phase is defined to mean a liquid solution, suspension or emulsion of the filler, which liquid is ameanable to movement by capillary action without substantial separation of the filler from the liquid during that movement. While any non-deleterious liquid (toward either the fibers or filler) may be used, it is preferred that the liquid (and resulting solution, emulsion or suspension) have a viscosity of less than 100 cp., e.g., 0.5 to 50 cp., a boiling point of less than 350°F., e.g., of from 100° to 300°F., and a freezing point of above 0°F., e.g., from 15° to 40°F. The liquid may be inorganic, e.g., water, or organic, e.g., lower alkanols, alkanoics, or alkanes up to 18 carbon atoms, glycerols, aliphatic lower ethers or esters, or mixtures thereof. Alternately, conventional liquid plasticizers, e.g., for polyvinyl chloride may be used, e.g., TCP.

As noted above, it is preferred that the filler be loosely bonded to the fibers and in this regard, where the filler may pass through an adhesive state, with respect to the fibers, precautions may be taken to insure that tight adherence of the filler to the fibers does not occur. The particular precaution may vary with the particular filler and liquid phase carrying the filler. However, either a temporary or permanent anti-stick may be used in this regard. For example, a solid silane dissolved in a solvent may be disposed on the fibers and after driving off the solvent, the silane anti-stick surface on the fibers will be relatively permanent. On the other hand, a non-permanent anti-stick may be provided by disposing on the fibers a liquid which is a non-solvent for the filler and maintaining that liquid on the fibers at least during the period that the filler is adhesive toward the fibers. Thereafter, the liquid may be removed by vaporization, washing, extraction, etc. It should be noted in this connection that even permanent kinds of anti-stick, as noted above, can be subsequently removed by solvent washing or extraction, although this complicates the process and is not a preferred procedure. The preferred form of the present invention is the use of the natural rubber latex and water as the anti-stick, as disclosed in the parent application.

As can be seen from FIG. 3, which is a photomicrograph showing a cross-section of the product cut at an angle of 20° to the face surface, the preferential disposition of the filler toward the face surface at least equals the bulk density gradient of the needled structure. Thus, this preferential disposition of filler at least preserves the density gradient of the needled structure, and in practice increases the ratio of bulk density of the back surface to the face surface of the resulting fabric, i.e., at least 1:2 and, usually 1:3 to 1:4, e.g., up to 1:8.

FIG. 4 is a 600 X photomicrograph of a small portion of the section at a position near the face surface. This shows the loose bonding of the clusters of particles to the fibers of the needled structure.

FIG. 5 is a 2300 x photomicrograph, also of a small portion of the section at a position near the face surface. Note the individual particles of filler making up the clusters of particles.

Figure 6:
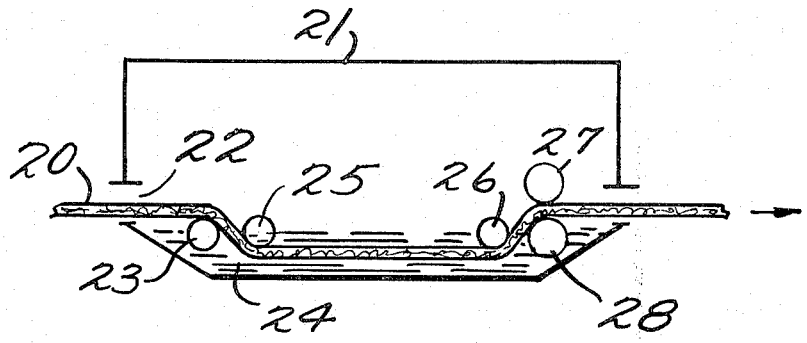
FIG. 6 is a diagrammatic illustration of apparatus suitable for applying a liquid phase filler to the needled fabric.

In FIG. 6, which is a diagrammatic illustration of the suitable form of apparatus for carrying out the liquid phase filler impregnation step of the present process, the needled structure 20 is passed into an enclosure, generally indicated at 21, through an entrance opening 22. The needled structure passes over roll 23 and is immersed in a liquid phase filler 24. The structure is held in the liquid phase filler by rolls 25 and 26. After the structure has become saturated with the liquid phase filler, it passes out of the liquid phase filler and between nip rolls 27 and 28 where the structure is lightly squeezed to remove a portion of a liquid phase filler contained therein. By squeezing the structure and removing the liquid, the structure no longer carries saturation amounts of liquid and voids will be present in the structure. The voids provide conditions whereby the capillary action can take place, as explained above. To a significant degree, the capillary action will depend upon the relative amount of void space in the structure. Thus, if the structure is only lightly squeezed and relatively small amounts of void space are produced, then the corresponding capillary action will not be as great. On the other hand, if the structure is relatively heavily squeezed and substantially more void space is produced, then the capillary action will be much greater. In this case, the tendency will be for increased movement of the liquid phase filler toward the face surface of the structure and a corresponding preferential disposition thereof. Thus, the amount of squeezing of the nip rolls and the corresponding amount of void space produced in the fabric can be used as a means of increasing the proportion of filler disposed toward the face surface.

After allowing the structure with the liquid phase filler therein to lag for a time sufficient that the capillary action will provide movement of the liquid, the solid filler is coagulated from the liquid phase filler in any desired manner to form the loosely bonded non-continuous particulate form of the filler. In the case of natural rubber latex (a preferred embodiment of the invention) coagulation is provided simply by subjecting the impregnated structure to saturated or slightly super-heated atmospheric steam. Of course, however, the particular coagulation means will be that conventionally used to precipitate the particular filler in the particular liquid.

Figure 7:
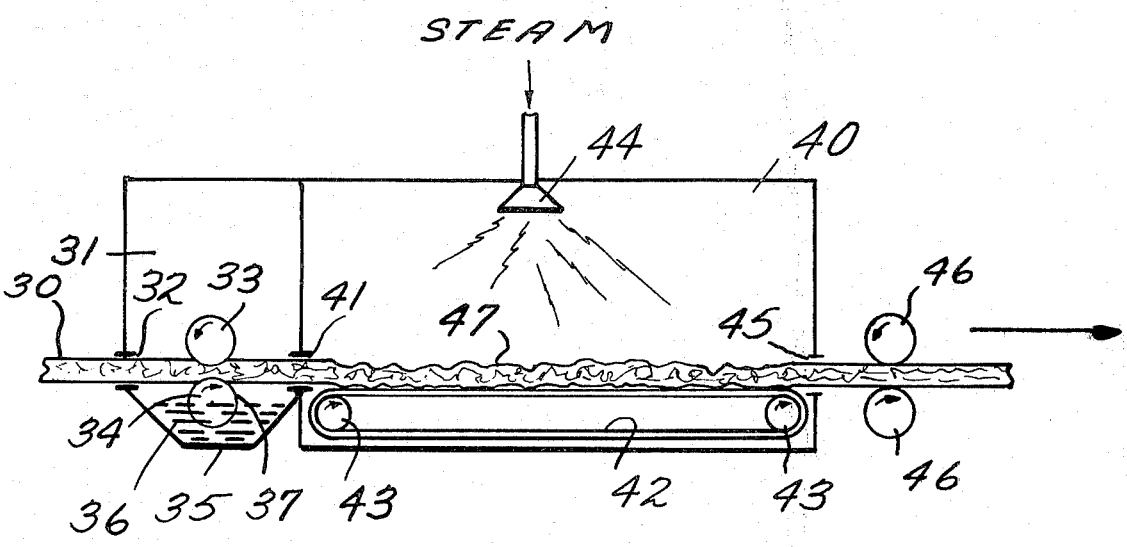
FIG. 7 is a diagrammatic illustration of a preferred apparatus for applying the liquid phase filler to the needled fabric.

FIG. 7 shows, in diagrammatic form, suitable apparatus for carrying out the present process as shown. Fabric 30 is passed into chamber 31 through opening 32 and between counterrotating rolls 33 and 34 (or a plurality of counter-rotating rolls operating in a like manner). Roll 34 rotates in a suitable reservoir 35 containing the liquid phase filler 36. Roll 34 may have a surface 37 which carries a metered amount of liquid phase filler 36. The surface 37 may be a grooved surface, e.g., a knurled surface, the grooves of which will provide the desired amount of the liquid phase filler. Alternately, the surface 37 may be a porous surface, e.g., a felt or foam, which will also provide a metered amount of liquid phase filler to structure 30. The transfer of the liquid phase filler from roll surface 37 to structure 30 is in part metered by cooperating nip roll 33. In this regard, the relative pressure exerted on fabric 30 by roll 33 will affect the amount of liquid phase filler transferred from surface 37 to structure 30 and subsequently retained thereby. Accordingly, by adjusting the pressure exerted by roll 33, the amount and disposition of the liquid phase filler transferred to, pressed into and retained by the needled structure 30 can be controlled. This pressure-metering is in addition to, or in cooperation with, the metering accomplished by the nature of surface 37. Also, as will be quite apparent, the physical properties of the liquid phase filler may be changed to affect different transfers and retention of the liquid phase filler to the needled structure. For example, the viscosity of a liquid phase filler may be changed by the addition thereto of thickening agents, or by increasing or decreasing the temperature thereof. Additionally, thixotropic agents may be added to the liquid phase filler. Other ingredients for changing the physical properties, especially viscosity and surface tension, of the liquid phase filler may be used in this regard.

As can be understood from the above, the compression of the needled structure as it is pressed between the counter-rotating rolls forces the fibers closer together and temporarily increases the density of the structure immediately between the rolls. As explained above, this increases the capillary force and enhances movement of the liquid phase filler. Accordingly, the amount and disposition of the liquid phase filler can be metered by adjusting the compression forces exerted by the rolls on the needled structure.

Of course, the effects of gravity, as discussed above, can be used to intensify or decrease the capillary effect of the needled structure by disposing the structure so that the face surface thereof is either upwardly or downwardly (as is also true of the arrangement shown in FIG. 5). Suitably, the structure is passed from chamber 31 to steam chamber 40 by entrance opening 41 having therein saturated or superheated steam, as discussed in connection with FIG. 6. The structure may be simply dofted onto a conveyor belt 42 moved by driven rolls 43. The steam is introduced into steam chamber 40 by distribution nozzle 44 from a source not shown. The steam will coagulate and cure the rubber in the latex and thereafter, the structure is passed out of steam chamber 40 by way of exit opening 45, as urged outwardly by nip rolls 46. During the steaming, the structure is preferably in a relaxed condition, as shown at 47, so that coagulation of the rubber can take place without stresses between fibers abnormally affecting the point or points where the particles and/or clusters of particles loosely bond to the fibers. This also allows for more uniform penetration of the steam into the structure. By virtue of the presence of water remaining after the coagulation of the particles of rubber from the latex and the addition of water from the condensation of steam on and in the structure, a film of water on the surfaces of the fibers is provided and this film of water functions as an anti-stick and insures only loose bonding of the rubber particles and/or clusters to the fibers.

It will also be apparent to those skilled in the art that other means of applying the liquid phase filler can be used. Thus, the liquid phase filler may be placed onto the structure by spray nozzles, curtain coaters, doctor blades, ink rolls, screen printing, etc. Compression, e.g., by rolls, of the needled structure to improve conditions for capillary action of the liquid phase filler can be carried out as a subsequent step.

Also, the lagging time can vary considerably depending on the particular density of the needled structure, viscosity and wetting properties of the liquid phase filler, the temperature of lagging, etc. The purpose of lagging is simply to provide sufficient time for the movement of the liquid phase filler to take place by capillary action. Capillary action equilibrium, i.e., where essentially no significant further capillary action movement takes place, can be established quite rapidly for some needled structures and some liquid phase fillers, while others will require longer times. In any case, it is preferred that the impregnated structure be lagged until capillary action equilibrium has been substantially reached. This will occur with liquids and needled structres, as above discussed, within 1 to 10 minutes, usually within 30 seconds and often within 10 seconds, e.g., from ¼ to 7 seconds.

It should be further understood that, similarly to the lagging step, the coagulation step may vary widely in specific practice. The particular means of coagulation of the filler from the liquid phase will be according to conventional practices for precipitating the particular solid filler particles from the particular liquid. For example, the solid filler may be precipitated from a solution by concentrating the dissolved solids in the solution, e.g., by evaporating the solvent, vaporizing a volative stabilizing component, extracting the solvent with a common solvent, adding additional solute to the solution, etc. Alternatively, the filler may be coagulated by lowering the temperature of the impregnated structure or agglomerating by induced nuclearization of solute by, for example, ultrasonic energy. Suspensions of fillers, e.g., emulsions or colloidal suspensions, can be coagulated by mechanically breaking the suspension, e.g., ultrasonic energy or freezing, or chemically breaking the suspension, e.g., pH changes, salting out of the suspension, etc. Of course, monomeric materials may be coagulated by induced polymerization to form insoluble polymers, e.g., by heating a water emulsion of an unsaturated lower alkyl ester, such as methyl acrylate, and benzol peroxide, with or without ultraviolet light.

The liquid remaining in the structure, after coagulation and/or curing, may be removed by heating to evaporate, e.g., up to 375°F., but usually above 100°F. Alternately, the liquid may be pulled out by vacuum or evaporated by flushing with a gas, e.g., air. Of course, combinations of the foregoing may be used. Excess liquid should be essentially removed from the fabric, at least the fabric should be dry to the touch, e.g., moisture contents of 15w/w% or less.

For purposes of the present specification, the overall bulk density referenced herein is defined as the weight per volume wherein the thickness of a section of fabric or needled structure is determined for the volume calculation by pressing a 1.129 inch diameter presser foot (1 square inch) against a section of the fabric or needled structure held on a 2-inch diameter anvil where the presser foot is loaded with 10 ounces of weight, and measuring the thickness of the section. This is a standard means in the art of determining the overall bulk density of felt-like fabrics. (For more details, see ASTM test D-461-67).

The needling operations may be carried out by any conventional needling looms, but it is preferred that FIBERWOVEN looms be used. These looms are described in U.S. Pat. Nos. 3,112,552; 3,090,099; 3,090,100; 3,112,549; 3,112,548 and 3,132,406, which disclosures are incorporated herein by reference.

The invention can better be understood by way of specific examples which follow but it is understood that the invention is not restricted to the examples but is applicable to the foregoing disclosure.

EXAMPLE 1

As described in Example 1 of the aforenoted parent application, a mat of staple polyester fibers (1½ to 5 denier and 1½ to 3 inches crimped length) was needled in FIBERWOVEN looms with 1-16-4C or- 3C needles (1-barb-16 mil triangular blade-4 or -3 mil barb depth) until a density of about 8 pounds per cubic foot was reached. The fabric was then saturated with a needling fluid composed of a 6% solids, water solution of an amine salt of coconut fatty acids (Penetrant GWX, Woonsocket Color and Chemical Co.) and further needled until a density of about 14 pounds per cubic foot was reached. Altogether the fabric was needled about 22,000 needle punches per square inch.

The needled fabric was washed in clean water to remove the needling fluid and squeezed to remove the wash water therefrom. The fabric was heated with an open flame and dried at temperatures less than 250°F.

In order to correct the out-of-balance modulus and to relax the needled fabric, the fabric was passed through a series of six nips formed between six pairs of rolls. One roll of each pair had a grip impregnated rubber surface and the other roll of each pair carried carding wire on its surface. The peripheral surface speed of the rubber surfaced roll was approximately 35% greater than that of the roll carrying the carding wire surface. The machine direction length of the fabric was decresaed by 15%. The rolls of the machine were adjusted so that the outermost portion of the wires of the card wire roll lightly touched the surface of rubber surface roll. The fabric was heated at the face surface for approximately 4 to 5 seconds by contact with a close-fitted curved aluminum shoe heated to 390°F. before the fabric was released from the last roll with the card wire surface.

The fabric was lightly sanded on the back face to even the thickness of the fabric, and immediately passed to a travelling belt press. A portion of the top belt was heated to 460°F so that the fabric passing between the top and bottom belts was in contact with the 460°F heated portion of the belt for only about 6 seconds. The face surface of the fabric contacted the top heated belt. Latter portions of both the top and bottom belts were cooled by circulating cooling water through a flat heat exchanger over which the belts passed and these latter portions of the belts were maintained at temperatures below about 200°F. Before releasing the pressure on the fabric exerted by the belts, the fabric was cooled to below 200°F. The pressure on the belts contacting the fabric was 60 psi.

The fabric, after passing through the belt press, had a thickness of about 66 mils and a weight of about 14 ounces per square yard, i.e., a density of about 17 pounds per cubic foot.

The fabric was impregnated with a natural rubber latex having the following compositions:

| | Parts by Weight |
|---|---|
| A-Component | |
| Natural rubber latex — (Lotol GX-3289 Uniroyal Chemical) | 100 |
| Water | 34 |
| Sodium polyacrylate water soluble latex thickener (Acrysol ASE 60 Rohm & Haas) | 0.34 |
| Ammonium Hydroxide | to adjust pH to 8.0 |
| B-Component | |
| Water | 4.91 |
| Potassium oleate | 2.77 |
| Ammonium Chloride (20% with ammonia added to pH 10) | 0.96 |
| Zinc Mercaptobenzothiazide (Uniroyal NX-503-C,OXAF) | 1.09 |
| Sulfur (in dispersion from — Uniroyal NX-762-B) | 1.09 |
| Zinc Oxide (in dispersion form — Uniroyal NX-935 | 1.04 |
| Zinc dibutyldithiocarbamate (Uniroyal Butazate-50-D) | 0.58 |
| Aqueous carbon black pigment dispersion at 30% solids) | 2.84 |

Components A and B are mixed at 3 parts A to 1 part B.

The fabric was immersed in the impregnant composition and then squeezed lightly to produce a weight add-on of approximately 150%.

The impregnated fabric was passed immediately into a steam chamber maintained at atmospheric pressure and containing steam superheated to about 218°F. The fabric remained in the chamber for about 10 minutes with minimum contact of the fabric with the surfaces of the chamber. The solids of the impregnated composition were coagulated and cured during the steam treatment.

The fabric was then passed out of the steam chamber and dried at temperatures less than 250°F.

The back surface of the fabric was lightly sanded with 180-grit abrasive paper to remove about 2 mils of material from the back surface. The face surface was sanded with the same paper in a belt sander to remove up to about 5 mils from the face surface and produce an upstanding fiber surface.

A viscous urethane prepolymer was applied to the face surface of the fabric with a thin flexible steel doctor blade having a square tip with rounded edges and inclined at 80° from the horizontal in the direction opposite to the movement of the fabric. The thin blade was 0.032 inch thick and extended beyond the jig holding the blade. The blade had a pressure of 2½ pounds per linear inch thereon, applied by a pneumatic cylinder with 15 p.s.i.g. pressure. The urethane prepolymer composition had the following formula.

| | Parts by Weight |
|---|---|
| Prepolymer of polytetramethylene-ether glycol (MW 1000) and tolylene-2, 4-diisocyanate* | 100 |
| Phenyl diisocyanate | 22 |
| Trichloroethylene | 30 |

*The Adiprene L series produced by E.I. du Pont and the Daltoflex A-40 series produced by ICI America are urethane rubber prepolymers and are equivalents for the present purposes.

The fabric with the prepolymer thereon was dried under infrared lamps in a dryer. The amount of dried prepolymer on the fabric was about 1.3 grams per square foot.

The fabric was then allowed to lag at room temperature for about three hours until the urethane prepolymer cured to approximately 30% of the maximum potential cure (crosslinking) and then plated in a belt press with the top belt heated to 400°F and pressed at 20 pounds per square inch for 8 seconds.

A base color finish was sprayed onto the fabric surface using an atomizing nozzle with a pressure of 45 pounds per square inch. The base color finish had the following formula:

| | Parts by Weight |
|---|---|
| Primal Ochre (pigment) | 15 |
| Primal White 264 (pigment) | 9 |
| Primal Red (pigment) | 1 |
| Water | 38.5 |
| Flexible unplasticized emulsion of 74/20/3/3 copolymer of ethyl acrylate, methyl acrylate, methylol acrylamide and methacrylic acid** | 36.5 |

**Primal 510, Rohm & Haas Co. is equivalent for purposes of the present invention.

The base color finish was then dried under infrared heaters (temperatures less than 200°F on base finish) to provide a dried finish of about 0.8 gram per square foot.

The fabric was then embossed at 345°F for 15 seconds using a Sheridan Batch Press with a pressure of about 500 pounds per square inch. The top platen was grained to resemble leather and the bottom platen was flat. The embossing step reduced the thickness of the fabric about 10% and produced a leather grained surface texture. Two additional color coats of the above-described finish, providing an additional 0.8 gram per square foot of base color coat, was applied to the surface and dried as above discussed.

A top finish coat was then sprayed on the fabric. The spraying was accomplished with an atomizing spray nozzle using 45 p.s.i. pressure. The spray was inclined at an angle to the fabric of about 30° in order to highlight the embossed surface texture. The top finish coat was dried under infrared heaters (temperatures of finish coat of less than 200°F) to produce a dried coating of about 0.3 gram per square foot. The formula of the top finish coat was as follows:

| | Parts by Weight |
|---|---|
| Nitrocellulose lacquer | 50.0 |
| Methyl ethyl ketone | 15.0 |
| Di-isobutyl ketone | 30.0 |
| Carbon black | 5 |

The fabric was then fully cured at 330°F for 2 minutes in a tunnel drier.

The back surface of the fabric was sprayed with a solution of a leather softener of the following formula:

| | |
|---|---|
| Sulfonated animal and vegetable fat, 2½% – 5% $SO_3$ content | 12 |
| Water | 88 |

The leather softener was applied in an amount of about 3 grams per square foot. The leather softener improves the hand of the fabric, in terms of leather, and also provides a leather odor to the fabric.

The fabric was mechanically softened by boarding in a conventional leather boarding machine with the face surface contacting the rolls of the boarding machine.

The resulting product was supple, having the feel, grainy appearance, color and texture of leather. The density of the material was approximately 35 pounds per cubic foot. The bending break had 18 wrinkles per inch indicating the flex axis very near the face surface. The bulk density gradient from the back surface to the face surface was approximately 1:2.5. The product with this type of finish had a SATRA standard moisture transmission of 1.6 mg/sq. ft./sec. (natural leather has 1.0–3.0 and CORFAM has 0.5 to 1.5). The material was fabricated into a number of pairs of shoes (shoe uppers), in the same manner as leather and wear tests showed that material was at least equal to leather in foot comfort and durability provided by the shoe uppers. With minimum polymer in the surface matrix and with less total amounts of finishes and color coats, however, moisture transmissions of up to 2.5 can readily be obtained with the present products.

What is claimed is:

1. A filled textile fabric characterized by high bulk density, a network of entangled fibers and a positioned axis of flexure; comprising textile fibers needled together into an integral needled structure having coherent fiber entanglement and an overall bulk density of at least 10 pounds per cubic foot; and a filler within the needled structure preferantially disposed toward the face surface thereof in an amount insufficient to fill all of the intersticies between the fibers of the structure; said filled fabric having an overall bulk density of between 20 and 60 pounds per cubic foot, a bulk density gradient wherein the bulk density increases from the back surface of the fabric to the face surface thereof and an axis of flexure which lies within about 0.4 of the distance from the face to the back surface.

2. The fabric of claim 1 wherein the needled structure has a bulk density gradient where the bulk density increases from the back surface to the face surface and the bulk density gradient of the needled structure is provided by a needle pick-up gradient which decreases from the back surface to the face surface.

3. The fabric of claim 2 wherein the bulk density gradient of the needled structure is provided by a needled plurality of layers of fibers and the average fiber denier and/or length of the layers decreases from the back surface to the face surface, the average denier of the fibers being between about ½ and 8 and the average length of the fibers being between ¾ inch to 4 inches.

4. The fabric of claim 3 wherein, after needling, the distinct layers of fibers are not substantially preserved but the said decreasing fiber denier and/or length gradient of the needled structure is substantially preserved.

5. The fabric of claim 4 wherein at least one layer of relatively short fibers are superimposed and needled on and into the face surface of the needled structure, said relatively short fiber having an average length of less than ¾ inch, whereby the bulk density at and adjacent to the face surface of the structure is increased and defines a dense region of bulk density higher than the bulk density of the remaining portion of the needled structure.

6. The fabric of claim 5 wherein the axis of flexure lies at least close to the dense region.

7. The fabric of claim 6 wherein the axis of flexure lies in the dense region.

8. The fabric of claim 2 wherein the axis of flexure lies within 0.3 of the distance from the face surface to the back surface.

9. The fabric of claim 1 wherein the coherent fiber entanglement of said needled structure includes some of the fibers being oriented into closely spaced rows of fiber chain entanglement.

10. The fabric of claim 1 wherein the overall bulk density of the needled structure without the filler is at least 12 pounds per cubic foot.

11. The fabric of claim 1 wherein the overall bulk density of the fabric is at least 25 pounds per cubic foot.

12. The fiber of claim 11 wherein the needled structure has a ratio of bulk density at the back surface to the face surface of at least 1:2.

13. The fabric of claim 1 wherein fibers of the needled structure at and adjacent to the face surface have been shrunk and define a compacted region of higher bulk density near the face surface.

14. The fabric of claim 13 in which at least part of the fibers at and adjacent to the face surface are heat shrinkable.

15. The fabric of claim 1 wherein the filler is predominantly loosely bonded to the fibers of the needled structure.

16. The fabric of claim 15 wherein the filler is disposed within the needled structure in the form of solid particles.

17. The fabric of claim 16 wherein the filler is disposed within the needled structure in the form of clusters of the said particles.

18. The fabric of claim 17 wherein the filler is elastomeric.

19. The fabric of claim 18 wherein the filler contains natural rubber.

20. The fabric of claim 15 wherein the bulk density of said structure is at least 30 pounds per cubic foot.

21. The fabric of claim 1 wherein the filler is contained in the needled structure in an amount of between 10% and 200% of the weight of the fibers in the needled structure.

22. The fabric of claim 1 having a finish on the face surface.

23. The fabric of claim 22 having a leather finish on the face surface.

24. A method for producing a filled textile fabric comprising needling textile fibers together into an integral structure with a face surface and back surface so that the overall bulk density of the needled structure is at least 10 pounds per cubic foot and the bulk density increases from the back surface to the face surface and produces an axis of flexure within 0.4 of the distance from the face surface to the back surface; applying a liquid phase filler to the needled structure in an amount insufficient to fill the voids of the needled structure, lagging the structure for a time sufficient to allow the liquid to move by capillary action to preferentially dispose the liquid phase filler toward the face surface, coagulating the filler from the liquid phase into particulate form which is at most loosely bonded to the fibers of the structure, and removing the liquid phase from the structure, whereby the fabric produced has an overall bulk density of between 20 and 60 pounds per cubic foot and the said bulk density gradient and position of the axis of flexure of the needled structure is at least preserved.

25. A process as claimed in claim 24, in which the bulk density gradient of the needled structure is provided by superimposing layers of fibers into a web of fibers, at least some of which layers have different average fiber denier and/or fiber length, so that the average fiber denier and/or length of the layers decreases from the back surface of the web to the face surface of the web and needling the web of fibers.

26. A process as claimed in claim 25 in which needling is accomplished by needling the web of superimposed layers into a first needled structure with a bulk density of at least 6 pounds per cubic foot, laying on the face surface of the first needled structure a web of at least one layer of relatively short fibers and then needling the web of relatively short fibers into the first needled structure to produce a second needled structure with a bulk density of at least 10 pounds per cubic foot.

27. A process as claimed in claim 26 wherein the needled structure is further needled to produce a density of at least 12 pounds per cubic foot.

28. A process as claimed in claim 24 wherein the fibers of the needled structure are relaxed to adjust the modulus of the structure and then the structure is further densified by shrinking the fibers at and adjacent to the face surface.

29. A process as claimed in claim 28 wherein at least part of the fibers at and adjacent to the face surface of the needled structure are heat shrinkable and the further densification is accomplished by applying heat to the face surface while maintaining the back surface of the needled structure relatively cool.

30. A process as claimed in claim 24 wherein the filler is coagulated in the form of clusters of the particles.

31. A process as claimed in claim 30 wherein the filler is elastomeric.

32. A process as claimed in claim 31 wherein the elastomer contains natural rubber.

33. A process as claimed in claim 24 wherein the filler is contained in the needled structure in an amount of between 10% and 200% of the weight of the fibers in the needled structure.

34. A process as claimed in claim 24 wherein the density of the fabric is at least 30 pounds per cubic foot.

35. A process as claimed in claim 24 wherein the amount and disposition of the liquid phase filler applied to the needled structure is metered by passing the needled structure between counter-rotating rolls which are pressed against the needled structure.

36. A process according to claim 35 wherein the liquid phase filler is applied to the needled structure prior to the passage of the needled structure between the counter-rotating rolls.

37. A process according to claim 35 wherein the liquid phase filler is applied to the needled structure during passage of the needled structure between the counter-rotating rolls.

38. A process according to claim 35 wherein the needled structure is compressed during passage between the counter-rotating rolls so that the capillary action is increased.

39. A process according to claim 35 wherein the liquid phase filler is transferred from at least one of the said rolls to the said needled structure.

40. A process according to claim 39 wherein the roll which transfers the liquid phase filler to the needled structure has a surface which is grooved or porous.

* * * * *